United States Patent [19]

Krawczak et al.

[11] 4,013,846

[45] Mar. 22, 1977

[54] PISTON LOUDSPEAKER

[75] Inventors: William G. Krawczak, White Bear Lake; William M. Mularie, Stillwater, both of Minn.

[73] Assignee: Minnesota Mining and Manufacturing Company, St. Paul, Minn.

[22] Filed: June 1, 1976

[21] Appl. No.: 691,472

Related U.S. Application Data

[63] Continuation-in-part of Ser. No. 608,446, Aug. 28, 1975, abandoned.

[52] U.S. Cl. ..... 179/115.5 R; 179/120; 179/181 F; 181/150; 181/174

[51] Int. Cl.[2] ..... H04R 9/06

[58] Field of Search ..... 179/115.5 R, 117, 119 R, 179/120, 181 F; 335/231

[56] References Cited

UNITED STATES PATENTS

| | | | |
|---|---|---|---|
| 1,611,454 | 12/1926 | Joy | 181/164 |
| 1,616,185 | 2/1927 | Hahnemann et al. | 181/173 |
| 1,773,910 | 8/1930 | Lane | 181/173 |
| 1,794,957 | 3/1931 | High | 181/166 |
| 1,821,373 | 9/1931 | Blieberger | 181/174 |
| 1,824,664 | 9/1931 | Eggert et al. | 181/164 |
| 2,402,697 | 6/1946 | Turner, Jr. | 340/11 |
| 2,744,584 | 5/1956 | Hellon | 181/150 |
| 2,905,260 | 9/1959 | Williams | 181/167 |
| 2,923,369 | 2/1960 | Kuhl | 181/172 |
| 2,984,712 | 5/1961 | Fabel et al. | 179/115.5 VC |
| 3,013,905 | 12/1961 | Gamzon et al. | 179/115.5 PV |
| 3,046,362 | 7/1962 | White | 179/115.5 R |
| 3,072,213 | 1/1963 | Petrie | 181/171 |
| 3,073,411 | 1/1963 | Bleazey et al. | 181/173 |
| 3,095,941 | 7/1963 | Hassan | 179/146 R |
| 3,130,811 | 4/1964 | Petrie | 181/172 |
| 3,154,173 | 10/1964 | Petrie | 181/172 |
| 3,163,786 | 12/1964 | Dickinson | 310/27 |
| 3,190,389 | 6/1965 | Petrie | 181/165 |
| 3,268,672 | 8/1966 | Roesel, Jr. et al. | 179/115.5 R |
| 3,347,337 | 10/1967 | Chida et al. | 181/157 |
| 3,351,719 | 11/1967 | Schoengold | 179/115.5 R |
| 3,497,642 | 2/1970 | Pintell | 179/181 R |
| 3,509,290 | 4/1970 | Mochida et al. | 179/115.5 R |
| 3,553,392 | 1/1971 | Liebscher et al. | 179/115.5 R |
| 3,569,638 | 3/1971 | Schoengold | 179/115.5 R |
| 3,573,396 | 4/1971 | Schoengold | 179/115.5 R |
| 3,596,733 | 8/1971 | Bertagni | 179/180 |
| 3,651,283 | 3/1972 | Doschek | 179/115.5 R |
| 3,665,124 | 5/1972 | Sotome | 179/115.5 DV |
| 3,666,040 | 5/1972 | Junk | 181/150 |
| 3,674,946 | 7/1972 | Winey | 179/115.5 PV |
| 3,696,885 | 10/1972 | Grieg et al. | 181/141 |
| 3,718,779 | 2/1973 | Schoengold | 179/115.5 R |
| 3,767,005 | 10/1973 | Bertagni | 181/160 |
| 3,790,724 | 2/1974 | Schenkel | 179/180 |
| 3,801,943 | 4/1974 | Bertagni | 335/231 |
| 3,829,623 | 8/1974 | Willis et al. | 179/115.5 PV |

FOREIGN PATENTS OR APPLICATIONS

| | | |
|---|---|---|
| 217,579 | 6/1924 | United Kingdom |
| 317,134 | 8/1929 | United Kingdom |

*Primary Examiner*—George G. Stellar
*Attorney, Agent, or Firm*—Cruzan Alexander; Donald M. Sell; Terryl K. Qualey

[57] ABSTRACT

An electroacoustic loudspeaker having a rigid, lightweight diaphragm and a substantially closed loop magnet support of a magnetically permeable material having a channel-shaped cross-section and supported adjacent and spaced from the diaphragm with the open side of the channel facing the diaphragm. The magnet support carries a pair of magnets magnetized and positioned with opposite poles in spaced facing relation and a voice coil is secured to the diaphragm and lies in the gap between the magnets.

7 Claims, 7 Drawing Figures

PISTON LOUDSPEAKER

CROSS-REFERENCE TO RELATED APPLICATION

This application is a continuation-in-part of application Ser. No. 608,446, filed Aug. 28, 1975, now abandoned.

FIELD OF THE INVENTION

The present invention relates to a loudspeaker having a rigid, light-weight diaphragm.

BACKGROUND OF THE INVENTION

Loudspeakers have been constructed for some time utilizing rigid, light-weight diaphragms constructed of foamed plastics such as polystyrene. The combination of light weight and rigidity provides efficient tonally accurate sound reproduction. Exemplary structures are disclosed in U.S. Pat. Nos. 2,905,260; 3,046,362; 3,351,719; 3,509,290; 3,553,392; and 3,651,283. The use of rigid light weight expanded plastic diaphragms has permitted the use of broad surface diaphragms as in U.S. Pat. Nos. 3,351,719 and 3,509,290, which, acting as a piston, require only one-third the diaphragm excursion of the ordinary conical diaphragms.

Until now rigid, broad surface diaphragms have been driven using the same driving configuration as utilized with the conventional conical paper diaphragm. Using conventional magnet assemblies, the driver diameter is typically limited to one-half to two inches. When only one such driver is utilized it is centrally positioned and as the diaphragm area is increased the acoustic efficiency and the accuracy of sound reproduction decrease.

SUMMARY OF THE INVENTION

The present invention provides a loudspeaker comprising a rigid, light-weight diaphragm having broad front and rear faces, a magnetically permeable keeper having a channel-shaped cross-section and forming a substantially closed loop which keeper is supported adjacent and spaced from the rear surface of the diaphragm with the open side of the channel facing the diaphragm. A pair of continuous or segmented magnets formed of fine grain, high coercivity, permanent magnetic material are supported in spaced relation within the keeper channel, one along each side wall of the channel. The magnets extend around the substantially closed loop of the keeper and are magnetized and positioned with opposite poles in spaced facing relation. A voice coil is secured to the rear face of the diaphragm and is positioned in the space between the magnets around the substantially closed loop of the keeper.

The closed loop of the keeper and magnets may, unlike prior driving configurations, be adapted to the size, configuration and material of the diaphragm to appropriately distribute the driving force to obtain optimum response.

THE DRAWING

Figure 1:
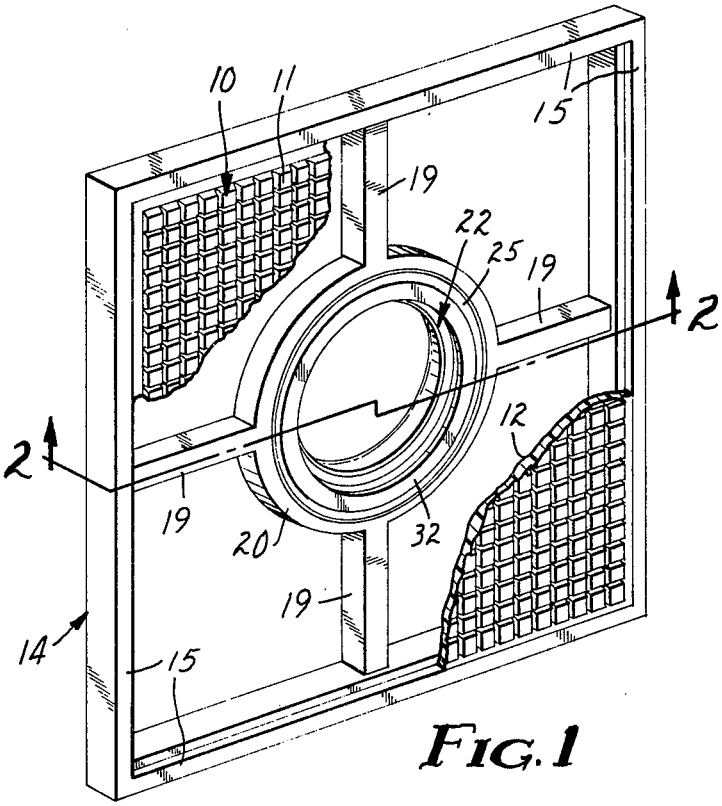
FIG. 1 is a front perspective view of a loudspeaker constructed in accordance with the present invention with a majority of the diaphragm broken away to expose the support and driving structure.
Figure 2:
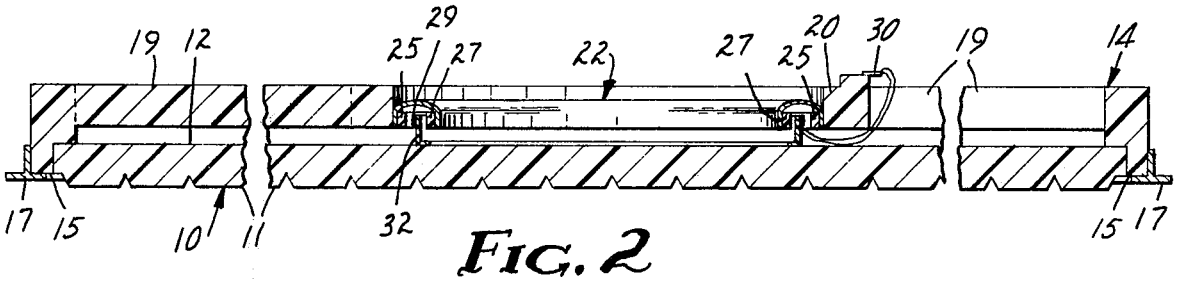
FIG. 2 is a cross-sectional view taken generally along line 2—2 of FIG. 1.
Figure 3:
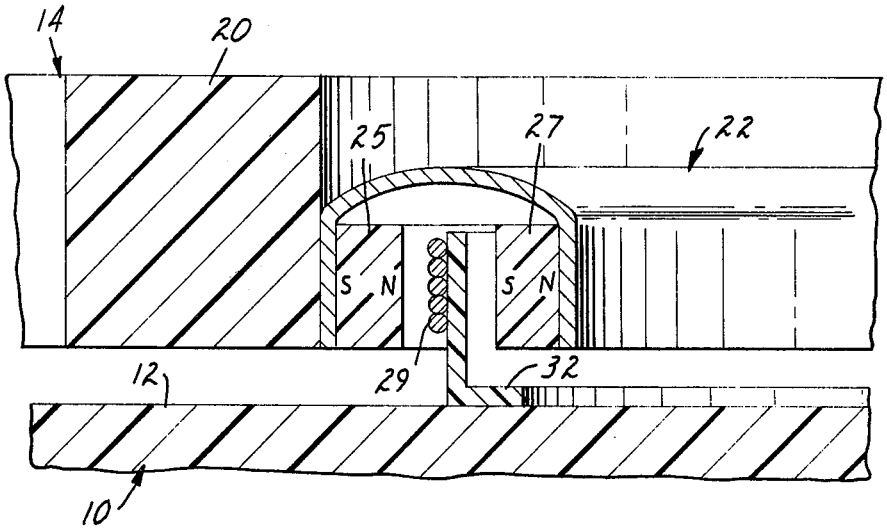
FIG. 3 is a cross-sectional view like that of FIG. 2 showing a portion of the driving structure.

The loudspeaker of the embodiment of the present invention illustrated in FIGS. 1 through 3 utilizes a rigid, light-weight diaphragm 10 having broad, generally planar front and rear faces 11 and 12, respectively. It is formed of a low density cellular plastic, for example expanded polystyrene or polyurethane having a density of 0.7 to 1.5 pounds per cubic foot such as is commercially available in billet stock, or it may be molded with a density of 1.5 to 8 pounds per cubic foot. The embodiment of FIGS. 1 through 3 is designed for use as a ceiling speaker and the front face 11 is formed with projections in a waffle pattern which has been found particularly good in distributing the sound produced. If desirable in the particular situation, however, the front face 11 of the diaphragm 10 may instead be molded or cut into other three-dimensional sound dispersing patterns or made to match the ceiling tile in the remainder of the ceiling.

The diaphragm 10 is supported around its periphery by a rigid plastic frame 14. Satisfactory edge termination of the diaphragm 10 to the supporting frame 14 may be made with a silicone adhesive or a similar sealant. The frame 14 is formed with a shoulder 15 around its periphery extending to the plane of the diaphragm for support on the usual T-bar support 17 of a T-bar suspended ceiling. The frame 14 is made 2 feet by 2 feet to fit in the usual opening in the support structure of a T-bar suspended ceiling.

The support frame 14 has four spokes 19 extending from its edges to a central support ring 20. A magnetically permeable soft iron keeper 22 having a channel-shaped cross-section is formed in a circular loop and is secured to the inside of the ring 20 of the support frame 14. The keeper 22 is supported by the frame 14 spaced from the rear face 12 of the diaphragm 10 with the open side of its channel facing the diaphragm 10.

A pair of magnets 25 and 27 are supported in spaced relation within the channel of the keeper 22, one along each side wall of the channel. The magnets are formed of fine grain, high coercivity, permanent magnetic material so as to prevent self-demagnetization. Such magnets are generally formed of barium ferrite or strontium ferrite particles dispersed in a non-magnetic immobilizing matrix, preferably a generally flexible binder, or they have been sintered to form a ceramic magnet. The flexible binder magnets are preferred since they may be more easily shaped and they are generally less expensive. One such suitable type magnet is available from the Minnesota Mining and Manufacturing Company with offices at Saint Paul, Minnesota under the trade name Plastiform.

The magnets 25 and 27 extend around the closed loop of the keeper 22 and are magnetized and positioned with opposite poles in spaced facing relation. The magnetically permeable keeper 22 thus provides physical support for the magnets and a low reluctance path for the magnetic lines of flux for increased efficiency.

A voice coil 29 is secured to the rear face 12 of the diaphragm 10 and is positioned in the space between the magnets 25 and 27 around the closed loop of the keeper 22. The ends of the coil extend to terminals 30 on the support ring 20. In the illustrated embodiment the voice coil 29 is supported by a rigid plastic ring 32 secured to the rear face 12 of the diaphragm 10 and having a flange extending perpendicularly therefrom into the gap between the magnets 25 and 27 where it supports the voice coil 29. Alternatively, the voice coil 29 may be molded into a ring formed as a part of the diaphragm 10 itself.

The driving structure, consisting of the keeper 22, the magnets 25 and 27 and the voice coil 29, may also be formed in oblong or rectangular configurations as may be desirable from the shape of the diaphragm. When a rectangular configuration is used it may be desirable to make each side of the rectangle a separate section with the pair of magnets and the keeper thus provided in segments, one along each of the sides of the rectangle, so long as the driving configuration in total provides a substantially closed loop. It may also be desirable in either the circular or rectangular configuration to form each of the pair of magnets of a multiplicity of segments, for example if ceramic magnets are utilized.

If a mid-range, high frequency radiator is desired, a second smaller concentric driving loop may, for example, be added to enhance the propagation of radial modes that contribute to higher frequency response.

Appropriate distribution of the driving force is achieved by matching the size and configuration of the driving loop to the size, configuration and material of the diaphragm. Such distribution results in lower distortion and better low frequency response than achieved with the prior art rigid planar diaphragm drivers. It has been found, for example, that with cellular plastic diaphragms good quality is achieved if the driving loop is spaced from the center of the diaphragm 10 approximately one-third of the distance from the center to the edge of the diaphragm.

Figure 4:
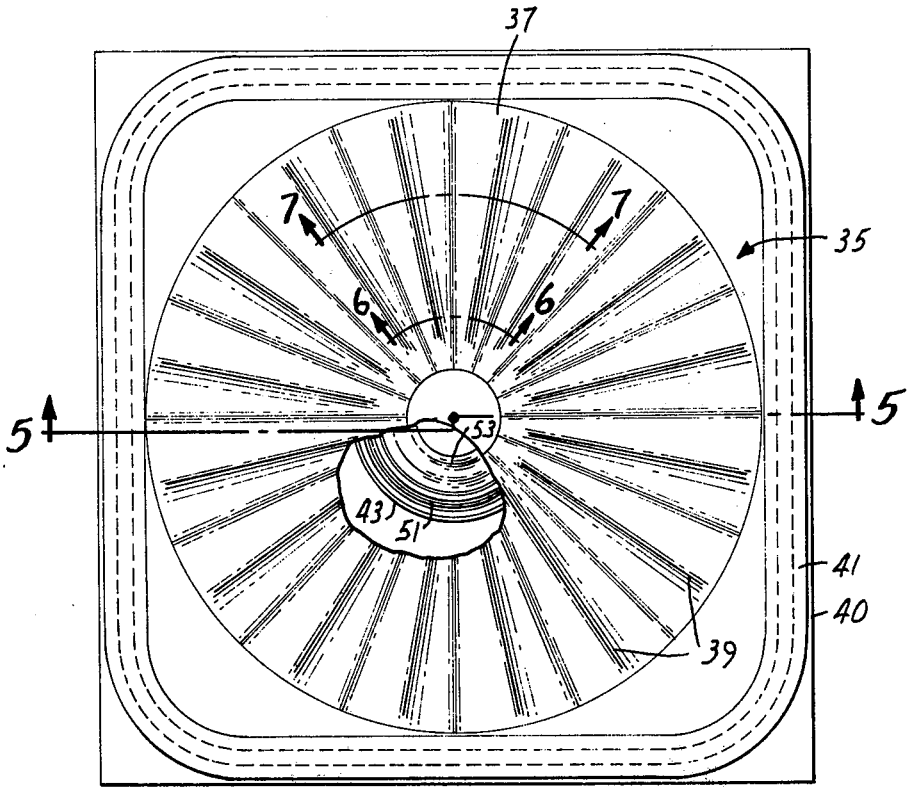
FIG. 4 is a front perspective view of a second embodiment of a loudspeaker constructed in accordance with the present invention.
Figure 5:
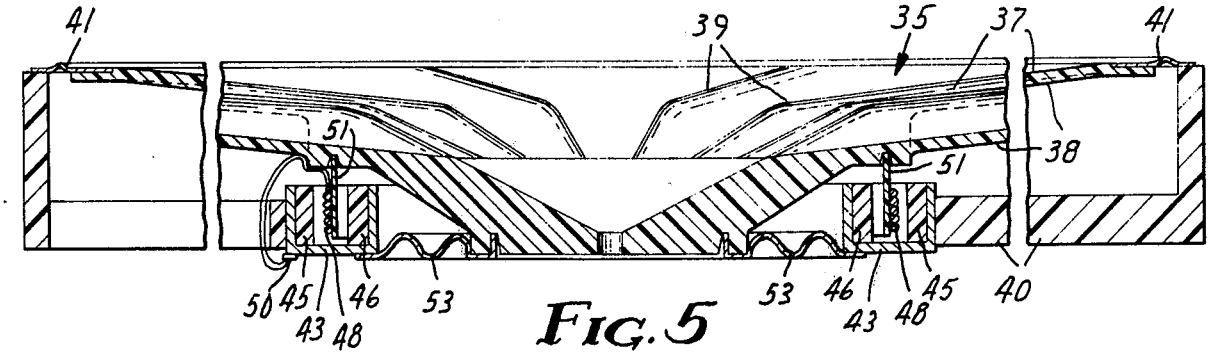
FIG. 5 is a cross-sectional view, similar to that of FIG. 2, taken generally along line 5—5 of FIG. 4.

Referring now to FIGS. 4 and 5, there is illustrated a second embodiment of a loudspeaker constructed in accordance with the present invention. The diaphragm 35, like that of the first embodiment, is a rigid, light weight diaphragm having broad front and rear faces 37 and 38. Within the present invention the diaphragm has broad front and rear faces if its depth parallel to the axis of the voice coil is less than the shortest distance across its front and rear faces (i.e. the faces extending perpendicular to the axis of the voice coil).

Figure 6:
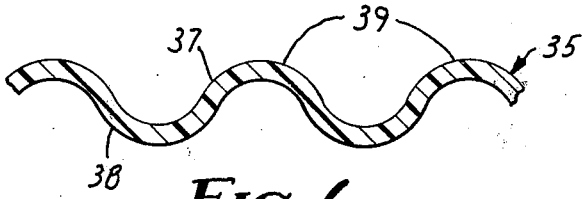
FIG. 6 is a cross-sectional view taken along line 6—6 of FIG. 4.
Figure 7:
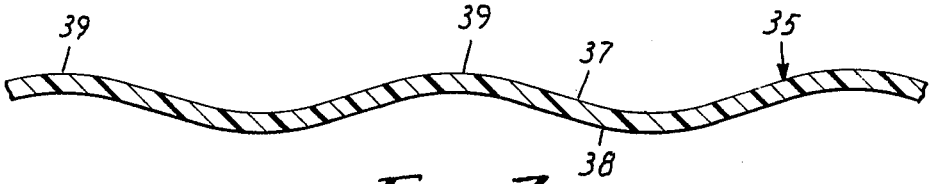
FIG. 7 is a cross-sectional view taken along line 7—7 of FIG. 4.

The diaphragm 35 is molded and thus has a density of from 1.5 to 8 pounds per cubic foot, preferably about two pounds per cubic foot. It has a curved front face 37 and an essentially parallel rear face 38, the front face 37 being smoothly curved in the radial direction with the greatest radius of curvature being at the center of the diaphragm. The diaphragm 35 also has similar, equally spaced circumferential undulations 39 (appearing on the front face 37 as radial ribs), which undulations 39 have progressively greater amplitude as they progress radially from the edge to the center of the diaphragm 35. (Compare FIG. 7 with FIG. 6.) This construction provides a diaphragm 35 in which the central portion of the diaphragm inside the voice coil is sufficiently stiff that the entire center of the diaphragm moves in phase with the voice coil and acts as the wave propagator. This eliminates the propagation of sound waves from the voice coil toward the center of the diaphragm which would cause distortion as they interfere in trying to cross the diaphragm center. Distortion levels and power handling capability are significantly improved by the diaphragm center stiffening. It is preferred to radially curve and circumferentially undulate the diaphragm to stiffen its center because stiffness can be easily controlled by changing the curvature (i.e. the greater the radius of curvature the stiffer) and the amplitude of the undulations 39, the diaphragm weight is kept to a minimum and sound is dispersed as by the waffle pattern of the first embodiment. However, the diaphragm center may also be stiffened by adding thickened radial stiffening ribs, by making the center thicker or by making the center of a higher density material.

The diaphragm 35 is supported by a rigid plastic frame 40, similar to the frame 14 of the first embodiment. However, in this embodiment the periphery of the diaphragm 35 is loosely joined to the rigid frame 40 by a corrugated edge compliance seal 41 of thermoformed polyester. The edge compliance seal 41 permits greater vibrational freedom in the diaphragm edge than the edge support of the first embodiment.

The diaphragm driving configuration in the second embodiment is also like that of the first embodiment. A magnetically permeable soft iron keeper 43 having a channel-shaped cross-section is formed in a circular loop and is secured to the inside of the ring of the support frame 40 as in the first embodiment. The keeper 43 is supported by the frame 40 spaced from the rear face 38 of the diaphragm 35 with the open side of its channel facing the diaphragm 35. A pair of magnets 45 and 46 are supported in spaced relation within the channel of the keeper 43, one along each sidewall of the channels, the magnets and their positioning being the same as described with respect to the first embodiment.

A voice coil 48 is secured to the rear face 38 of the diaphragm 35 and is positioned in the space between the magnets 45 and 46 around the closed loop of the keeper 43. The ends of the coil extend to terminals 50 on the support ring of the frame 40. The voice coil 48 is supported by an aluminum ring 51 secured to the rear face 38 of the diaphragm 35 by the diaphragm material itself as the diaphragm is molded.

The driving configuration of the second embodiment differs from that of the first embodiment in that the central portion of the diaphragm 35 is connected to the interior of the channel-shaped keeper 43 by a donut-shaped corrugated centering spider 53 of thermoformed phenolic resin impregnated cloth or thermoformed polyester. The centering spider 53 provides the major means of support of the diaphragm 35 on the support frame 40, the edge compliance seal 41 around the periphery of the diaphragm 35 only loosely holding the diaphragm edge. The centering spider 53 allows greater speaker efficiency due to the closer magnet spacing possible when radial stiffening is added and greater linearity and piston-like diaphragm movement. The concentric circular corrugations in the centering spider 53 provide excellent radial stiffness to hold the voice coil 48 centered between the magnets 45 and 46 while providing little resistance to axial movement of the voice coil 48. This feature reduces the distortion at low frequencies.

We claim:

1. A loudspeaker comprising:

a rigid, light-weight diaphragm having broad front and rear faces, a magnetically permeable keeper having a channel-shaped cross-section and forming a substantially closed loop, means supporting said keeper adjacent and spaced from said rear face of said diaphragm with the open side of said channel facing said diaphragm, a pair of magnets formed of fine grain, high coercivity, permanent magnetic material and supported within said keeper channel, one along each side wall of said channel, said magnets extending around said substantially closed loop of said keeper and being magnetized and positioned with opposite poles in spaced facing relation, and a voice coil secured to said rear face of said diaphragm and positioned in the space between said magnets around said substantially closed loop of said keeper.

2. The loudspeaker of claim 1 wherein said broad front and rear faces of said diaphragm are generally planar.

3. The loudspeaker of claim 1 wherein said diaphragm is formed of a low density cellular plastic.

4. The loudspeaker of claim 3 wherein said substantially closed loop of said keeper is spaced from the center of said diaphragm approximately one-third of the distance from the center to the edge of said diaphragm.

5. The loudspeaker of claim 3 wherein said front face of said diaphragm is formed with sound dispersing projections to aid in sound distribution.

6. The loudspeaker of claim 3 wherein said diaphragm and said means supporting said keeper are joined at the edges of said diaphragm to form an integral structure and wherein the edges of said integral structure are formed for support by the T-bar supports of a T-bar suspended ceiling.

7. The loudspeaker of claim 1 wherein said magnets are formed of fine grain, high coercivity magnetic material dispersed in a flexible non-magnetic immobilizing matrix.

* * * * *